United States Patent [19]

Nalbandian et al.

[11] 4,080,909

[45] Mar. 28, 1978

[54] POLLUTION FREE MULTI-CHAMBERED BURNER

[75] Inventors: Noubar Nalbandian; David P. Holmes, both of Seattle; Alan B. Fletcher, Kirkland, all of Wash.

[73] Assignee: Envirometrix, Inc., Seattle, Wash.

[21] Appl. No.: 618,826

[22] Filed: Oct. 2, 1975

Related U.S. Application Data

[63] Continuation-in-part of Ser. No. 524,973, Nov. 18, 1974, abandoned.

[51] Int. Cl.[2] ..... F23G 5/00

[52] U.S. Cl. ..... 110/235; 110/119; 55/316

[58] Field of Search ..... 55/316; 110/7 R, 8 R, 110/8 A, 8 C, 18 R, 18 C, 165, 119

[56] References Cited

U.S. PATENT DOCUMENTS

| | | | |
|---|---|---|---|
| 2,627,827 | 2/1953 | Elliott | 110/165 |
| 2,735,266 | 2/1956 | Atherton | 110/7 X |
| 3,068,812 | 12/1962 | Hemeon | 110/8 |
| 3,323,475 | 6/1967 | Melgaard | 110/18 |
| 3,387,574 | 6/1968 | Mullen | 110/7 |
| 3,483,677 | 12/1969 | Pinto | 55/316 |
| 3,516,370 | 6/1970 | Stribling | 110/7 |
| 3,547,055 | 12/1970 | Zanft | 110/8 |
| 3,702,594 | 11/1972 | Howes | 110/8 |
| 3,847,094 | 11/1974 | Taeymans et al. | 110/8 |

*Primary Examiner*—Kenneth W. Sprague
*Attorney, Agent, or Firm*—David H. Deits; Gene M. Grantham; Roy E. Mattern, Jr.

[57] ABSTRACT

A multi-chambered combuster apparatus for the controlled burning of all forms of light combustible organic material and the generation of steam or dry heat energy, resulting in essentially pollution free combustion as atmospheric emissions have zero opacity and low particulate discharge. A primary combustion chamber in which air and fuel are introduced in controlled ratio has interior walls acting as ignition surfaces which also direct combustants in a cyclonic flow path. Combustion gases then expand into a counterflow chamber where cooling and deceleration causes settling of pollutants. The gas stream next enters a purification chamber, passing through a hot filtering medium which entraps any remaining fine particulate matter.

16 Claims, 6 Drawing Figures

POLLUTION FREE MULTI-CHAMBERED BURNER

CROSS REFERENCE TO RELATED APPLICATION

This is a continuation-in-part application of application Ser. No. 524,973, filed Nov. 18, 1974 and now abandoned and priority of said application is claimed.

BACKGROUND OF THE INVENTION

In the past, the most common methods utilized by the wood products industry for the disposal of all forms of wood waste has been one of the following:

(A) Dumping

Traditionally, dumping has been accomplished on private or public open dumping facilities. This manner of disposal has created enormous land management problems, noxious odors, and of course, pollution of natural adjacent water sources.

(B) Ineffective Controlled Burning

The wood products industry has in the past used several methods of burning to eliminate unwanted wood waste. Such methods employed, have included the Wigwam or Tee-Pee burner, open pit burning, and many other forms of make-shift burners. Such methods of uncontrolled combustion have resulted in enormous particulate emission, and the ever-present danger of sparks causing fires adjacent to the burning site.

(C) Dutch-Ovens and Water Wall Boilers

The utilization of energy from wood waste has been practiced for many years. Dutch ovens, fire box under a hot tube boiler, were the initial attempt. These are grossly inefficient, very difficult to control, and cannot be internally filtered to control pollution.

In the water wall boilers, combustion is generated within a large space surrounded by tubes containing water. Radiant heat as well as heat transfer from combustion gases develops steam in the tubes. This was a more efficient steam producing process, but control was still difficult and pollution output was not reduced.

(D) Fuel Cells

Efficient combustion within a confined space was the next step in energy generation. A fuel cell is strictly a burner with the gases of combustion exhausted to a heat transfer medium. These have far better control of combustion, but produce a fine particulate discharge as pollution abatement is difficult and expensive, and these fine particules stay in the air stream and can be hazardous to health and well being.

The wood products industry needs a combuster design that will accomplish complete burning of wood waste in a compact and economical sized unit, permitting energy recovery and have the ability to meet particulate control levels set by law. The burners already developed could be used to accomplish this result but only with the addition of expensive external filter systems. The present invention is an efficient combustion unit, internally controlling discharge of pollutants, while destroying all types of light organic waste material.

With the development of the energy crisis, the increasing price of fuels long used for energy generation, natural gas, propane and diesel fuel, caused concern for the utilization of available energy already produced during destruction of organic waste. The present invention provides businesses and municipalities a constant source of steam energy as energy from the combustion process is efficiently recovered.

SUMMARY OF THE INVENTION

A multi-chambered combuster is utilized for energy generation and substantially pollution free combustion of all forms of light organic waste material. This combuster is particularly useful in the wood products industry where organic solid waste such as sander dust, sawdust and hogged fuels are used as fuel and steam or dry heat energy is generated, to be used as a replacement for commercial fuel such as diesel oil or other fossil fuel sources necessary for other routine industrial operations. This combuster may also be used by large or small municipalities as a supplementary energy source, through the controlled combustion of light organic municipal waste such as paper products, wood, light plastic and rubber, garden trimmings, textiles and food waste. The dimensions and parameters of the multi-chambered combuster are designed according to energy needs and waste destruction requirements of each particular user.

The primary combustion chamber has an inner wall of high temperature refractory material which acts as an ignition surface and directs fuel and air involved in the combustion process in a controlled airflow path within the combustion chamber. Initial combustion temperature is achieved with a manual or automatic ignitor, either gas or oil fired. As the temperature begins to rise, wood chips, sawdust or other combustible organic material is pneumatically conveyed into the combustion chamber. An induced draft fan is used to provide the necessary air flow for efficient combustion. To achieve the optimum air to fuel ratio for complete combustion, overfire air is controllably injected into the combustion chamber.

The pneumatically conveyed fuel and overfire air are both fed into the primary combustion chamber, directed toward the chamber inner wall so that a spiraling cyclonic flow path results. The combustion chamber inner wall is preferably cylindrical and the spiraling flow of combustants rises along substantially the full height of the chamber. This controlled flow results in complete mixture of air and fuel, in prolonged retention time of combustants within the chamber and disperses fuel along nearly the entire surface area of the chamber wall which acts as an ignition surface.

A construction near the top of the primary combustion chamber initially deflects the spiraling combustion gases back into the chamber, prolonging retention time and prohibiting the rapid exit of burning material. As combustion gases leave the primary combustion chamber through a portal at the top of the chamber, they enter the counterflow chamber. The counterflow chamber is much larger than the exit portal, allowing expansion and deceleration of the gas and causing a slight cooling effect. Also, the flow of combustion gases is directed downward causing some heavier particulate matter to leave the gas stream and collect at the bottom of the chamber.

The combustion gases continue through another portal into the purification chamber and rise upward through openings in a filter supporting element. The gas flow path then rises through a bed of filter aggregate, assisted by an induced draft fan. The filtering media entraps much of the remaining pollutants in a gas stream and also is heated by the gas flow to a high enough temperature to act as an afterburner to continue combustion of matter still retained in the flow path. The cleaned gases then exit through a refractory lined flue to be utilized as needed.

DESCRIPTION OF PREFERRED EMBODIMENTS

Method of Operation

Figure 1:
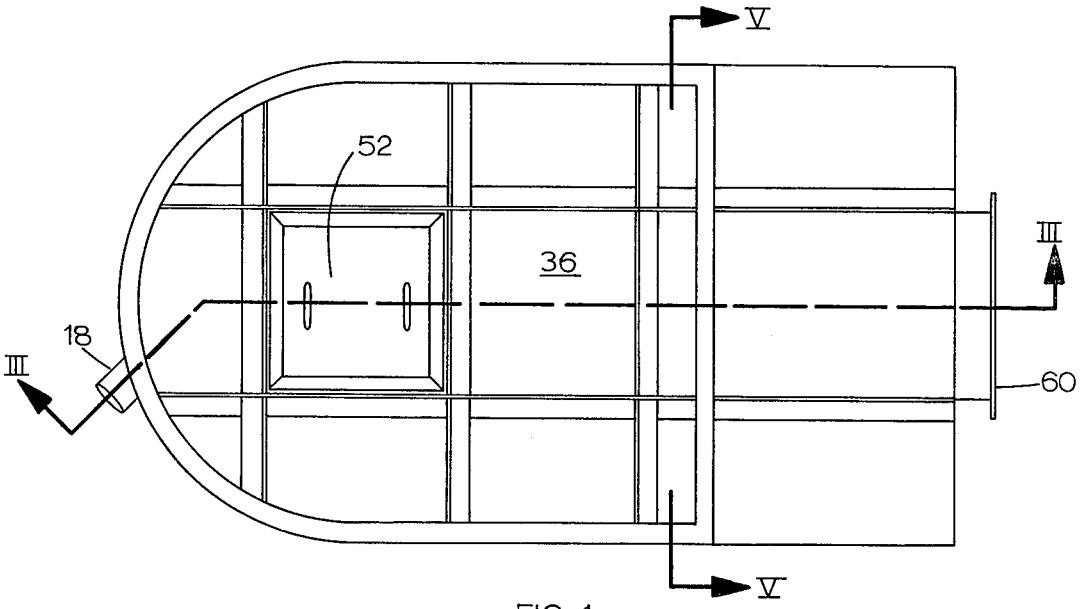
FIG. 1 is a top view of the multi-chambered combuster.
Figure 2:
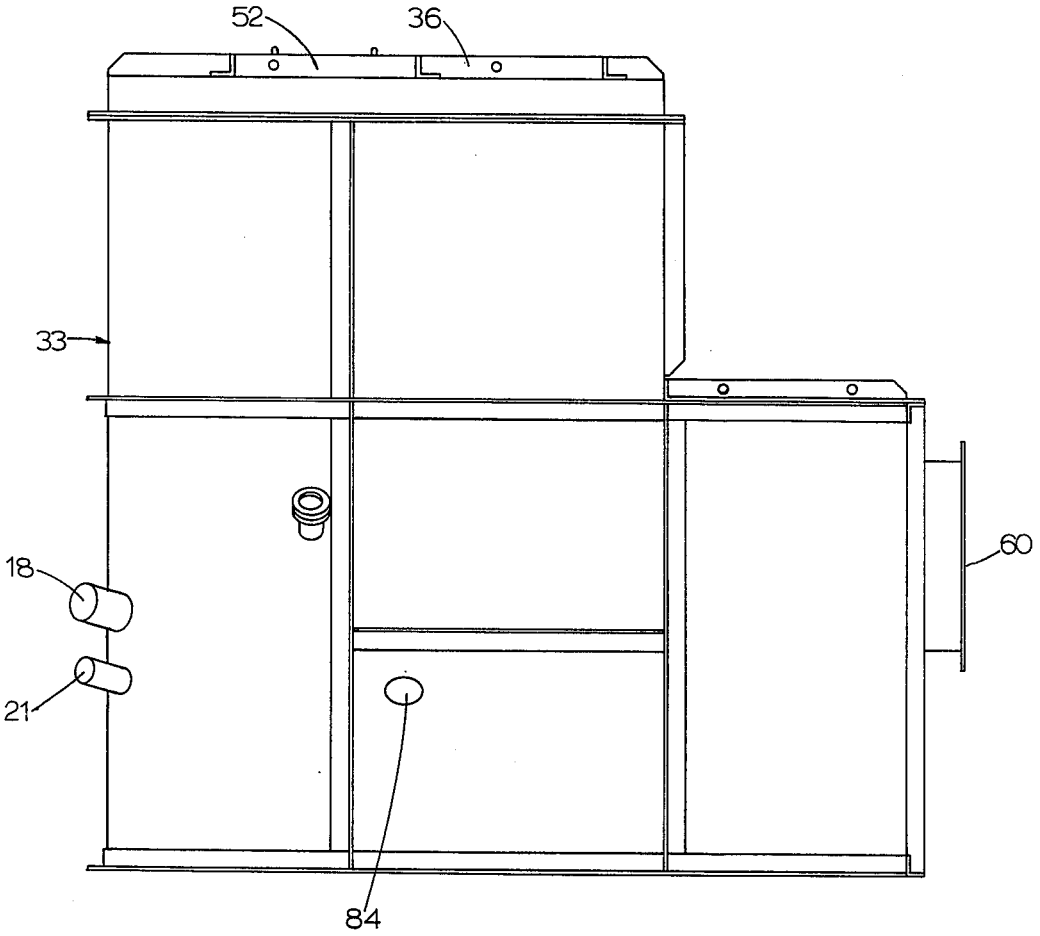
FIG. 2 is a side view of the combuster.
Figure 3:
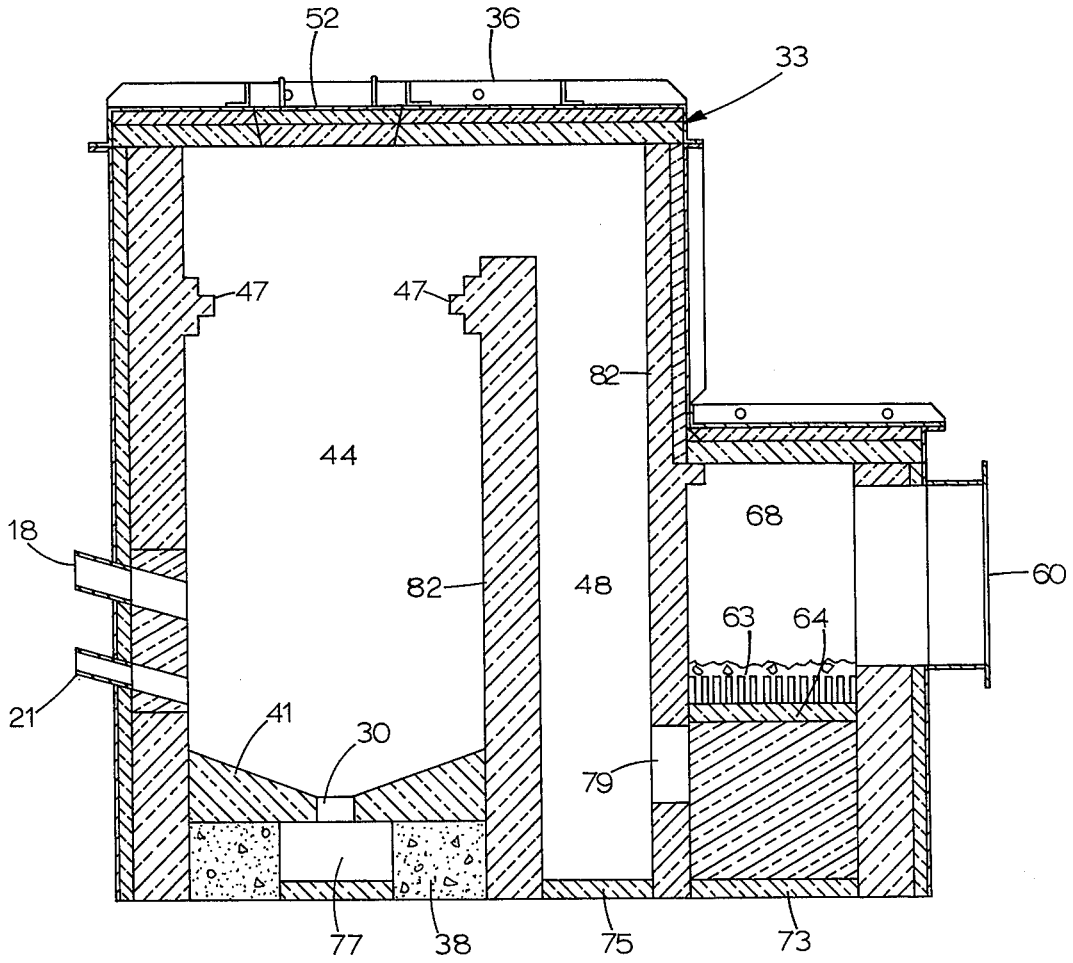
FIG. 3 is a cross sectional view of the combuster taken along the flow path of combustants as shown in FIG. 1.

FIGS. 1 and 2 illustrate the steel envelope of the multi-chambered burner 33. The individual chambers within the burner are lined with high temperature brick and refractory material 82 as shown in FIG. 3, to withstand high temperature and also provide insulation for efficient energy recovery from the combustion process. An access door 52 for inspection and maintenance is provided at the top of the combuster 33. All filtration and combustion are accomplished within the enclosure shown in FIGS. 1 and 2 and substantially pollution free heated air is recovered from the exit flue 60.

Figure 4:
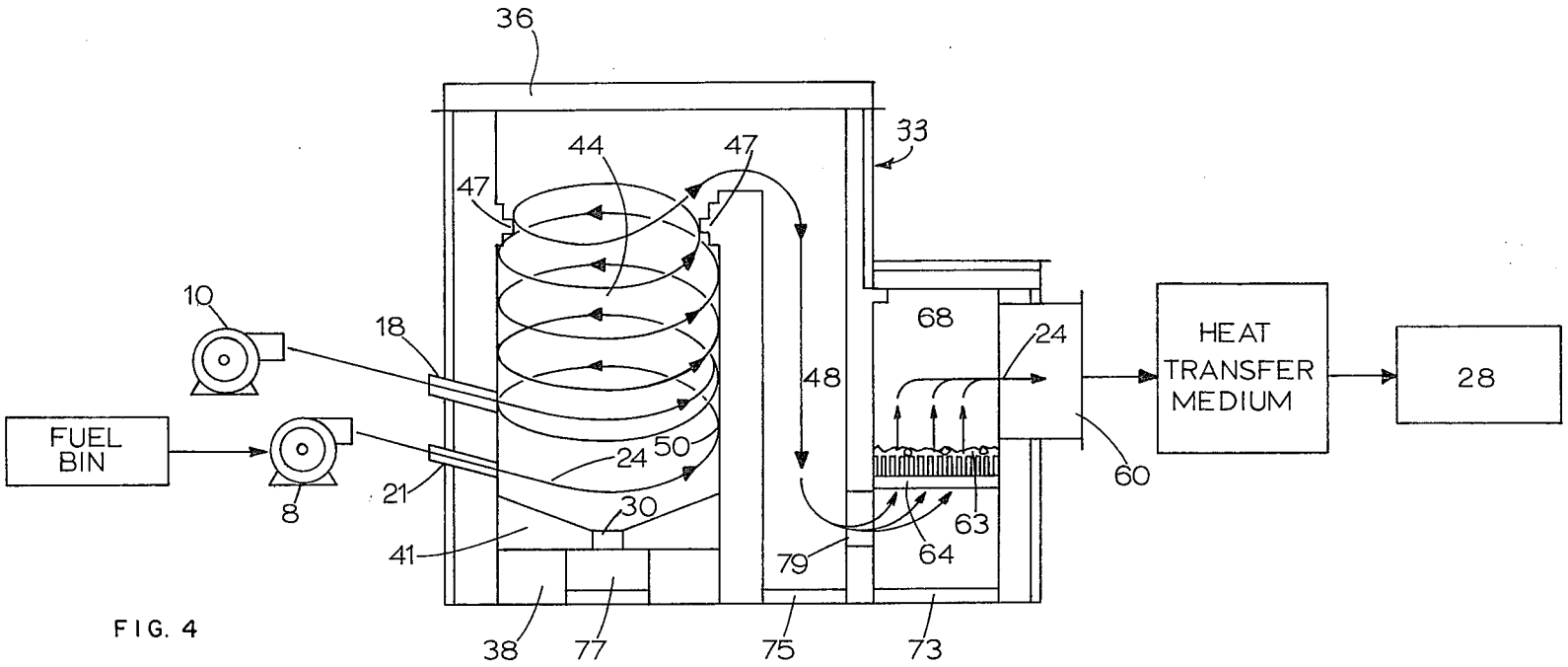
FIG. 4 is a schematic view illustrating the flow path of combustants.

In FIG. 4 a schematic view of the combuster illustrates by flow lines 24 the path of fuel and air during the combustion process and the removal of pollutants from the gaseous byproducts of combustion. Any light organic waste material of uniform size may be used as fuel and is continuously fed pneumatically by a blower 8. The same blower 8 provides primary air flow and the mixture of fuel and air is introduced into the combustion chamber 44 through a feed inlet 21. An overfire air inlet 18 introduces additional air for the combustion process and permits adjustment of the air to fuel ratio.

Initial start-up within the combustion chamber 44 is accomplished with a natural gas or propane igniter firing directly through igniter opening 84, into the combustion chamber 44, before feeding of volatile fuel materials. Depending on the ignition temperature of the fuel being used, additional amounts of fuels may be introduced through the pneumatic feed system until internal temperature is great enough to insure complete combustion. Continuous combustion may then be automatically or manually regulated by adjustment of the overfire air inlet 18 to control air to fuel ratio.

An induced draft fan 28 aids the flow of gaseous combustion by-products through the multi-chambered combuster 33, maintaining a slight negative pressure within the system. This avoids any requirement for multiple pressurized chambers or the possibility of backup, explosion or other outburst of gas. The flow path 24 continues through the counterflow chamber 48 and the purification chamber 68 where any pollutants are removed from the flow of hot gas.

Primary Combustion Chamber and Cyclonic Flow Pattern

Figure 6:
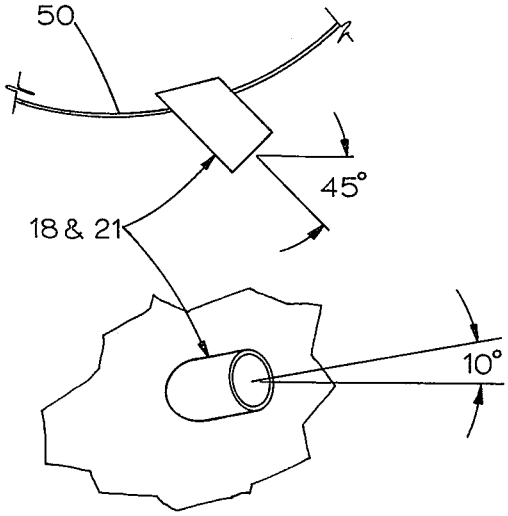
FIG. 6 illustrates the angle at which both fuel and overfire air are introduced into the primary combustion chamber.

The combustion chamber 44 is preferably cylindrical in shape with a high temperature cast base 41 having a hole 30 in its center to allow ash to discharge into the clean out pit 77. Primary air flow and fuel are introduced into the chamber 44 through a feed inlet 21. Additional air is added through the overfire air inlet 18. Both of these inlets 18, 21 are directed to approach the chamber inner wall surface 50 and are also directed slightly downward. Preferably both inlets 18, 21 are directed at 45° to a tangent of the chamber inner wall 50 and 10° downward, as illustrated in FIG. 6. The inner wall surface 50 acts to guide burning air and fuel in a cyclonic flow path 24 as shown in FIG. 4. As hot combustants rise within the combustion chamber 44, the cyclonic flow path 24 extends over substantially the full height of the combustion chamber inner wall 50. The high temperature refractory material of which the chamber inner wall 50 is constructed becomes hot enough during combustion to act as an ignition surface for combustants which are in close contact with the wall 50 and evenly dispersed by the cyclonic flow pattern 24.

Overfire Air and Fuel/Air Ratio Adjustment

The overfire air inlet 18 introduces air to promote the cyclonic flow path 24 within the combustion chamber 44 and also is regulated to adjust the air to fuel ratio within the combustion chamber. Both the overfire air inlet 18 and the fuel inlet 21 have variable pitch dampers which may be manually or automatically adjusted to vary input to the combustion chamber. As much as 50 to 200% excess air is introduced to insure complete combustion and to permit combustion at comparatively low temperature. The cooler temperature increases the life of the refractory material and decreases the amount of insulation required. The excess air also is an important factor in producing the cyclonic flow path 24 of intrained combustants.

Counterflow Chamber

Figure 5:
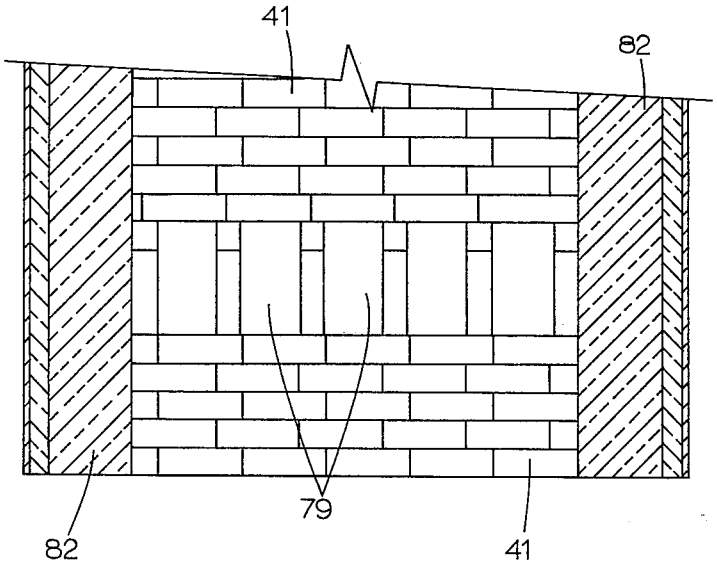
FIG. 5 is a sectional view of the wall between the counterflow chamber and the purification chamber, illustrating the passageway between these two chambers.

The flow of combustion gases, as illustrated in FIG. 4, expands from the constriction 47 at the top of the combustion chamber 44 into the larger counterflow chamber 48. As gases expand and decelerate in the counterflow chamber 48, they are also directed downward. Large particulate matter is propelled toward the floor 75 of the chamber or settles out of the gas stream. The counterflow chamber 48 is lined with bricks made of high temperature refractory material, and a passageway 79 is formed at the bottom of the chamber 48 as illustrated in FIG. 5, communicating flow of combustion gases into the purification chamber 68.

Purification Chamber

Hot combustion gases entering the bottom of the purification chamber 58 rise upward through a filter supporting element which supports a bed of high alumina aggregate 63. The aggregate acts as a filter to remove pollutants from the gas stream. Also the aggregate 63 temperature increases to that of the gas stream and the heated aggregate then acts as a surface burning media to cleanse the gas stream of any remaining combustible material. After passing through this last internal filtering stage, the heated gas flow passes through the exit flue 60, to be used as heat energy, efficiently recovered from the combustion process.

SUMMARY OF ADVANTAGES

The purpose of this invention is to produce a combuster for the destruction of all forms of light organic waste and the generation of a source of energy in compliance with all air pollution standards, having the following additional advantages:

(1) All combustion and filtration are accomplished within a compact unitary structure.
(2) Air/fuel ratios are readily controlled to establish consistant and complete combustion.
(3) A high percentage of usable energy is recovered.
(4) There is minimal use of ancillary fossil fuels.
(5) A large surface area ignition surface promotes thorough combustion of dispersed fuel.
(6) Use of a hot filtration medium insures ignition of all combustible pollutants.
(7) Cyclonic action within the combustion chamber promotes efficient and complete combustion.
(8) There is minimal build up of sludge or residue within the combuster.
(9) Preparation of organic waste material for use as fuel is minimal.

We claim:

1. A multi-chambered enclosure for substantially pollution free burning of organic waste material and for the generation of heat energy, comprising:

(a) a primary combustion chamber having a generally cylindrical inner wall acting as an ignition surface for combustants and restraining combustants in a spiraling cyclonic flow pattern dispersed along said inner wall;
(b) means for introducing air/fuel mixture to approach and converge toward the primary combustion chamber inner wall so that they flow tangentially along said cylindrical inner wall;
(c) an outlet passageway at the top of the primary combustion chamber;
(d) a counterflow chamber having an inlet passageway near its top in communication with the outlet passageway of the primary combustion chamber, said counterflow chamber being comparatively larger than its inlet passageway to expand and decelerate the gases; and
(e) a purification chamber containing porous filter material and having an inlet below said filter material in communication with the counterflow chamber.

2. A multi-chambered burning enclosure as claimed in claim 1, wherein air/fuel mixture is introduced into the primary combustion chamber having a horizontal component approaching and converging toward the generally cylindrical inner wall surface and also having a vertical component directed downward.

3. A multi-chambered burning enclosure as claimed in claim 1, wherein air/fuel mixture is introduced by the introduction means through the primary combustion chamber side wall having a horizontal component directed at an angle of 45° to a tangent to the inner wall surface and having a component directed at an angle of 10° downward from horizontal.

4. A multi-chambered burning enclosure as claimed in claim 1, further comprising overfire air injection means introducing air into the primary combustion chamber, said injected air directed to approach and converge with the generally cylindrical inner wall.

5. A multi-chambered burning enclosure as claimed in claim 1, wherein the primary combustion chamber inner wall is constructed of high temperature refractory material.

6. A multi-chambered burning enclosure as claimed in claim 1, further comprising an induced draft fan, creating a negative pressure within the burning enclosure.

7. A multi-chambered burning enclosure as claimed in claim 1, further comprising an induced draft fan connected to the purification chamber, creating a negative pressure within the burning enclosure.

8. A multi-chambered burning enclosure as claimed in claim 1, wherein the otherwise generally cylindrical primary combustion chamber has a constriction near its top.

9. A multi-chambered burning enclosure comprising:

(a) a primary combustion chamber having a generally cylindrical inner wall surface, the axis of said cylinder being vertical;
(b) means for introducing an air/fuel mixture so that they flow along said cylindrical wall surface so that during operation the wall acts as an ignition surface and directs and constrains combustants in a spiraling cyclonic flow path along substantially the full chamber height;
(c) additional means for introducing air into the primary combustion chamber, directed to approach and converge with the combustion chamber inner wall to promote the cyclonic flow;
(d) a restrictive outlet passageway at the top of the primary combustion chamber;
(e) a counterflow chamber having an inlet passageway near its top in communication with the outlet passageway of the primary combustion chamber; and
(f) a purification chamber having an inlet near its lower end in communication with said counterflow chamber and containing aggregate filter material which is heated by the flow of hot gases to act as an ignition and combustion medium for combustible pollutants.

10. An incineration combustion chamber, comprising a cylindrical inner wall surface, the longitudinal axis of said cylinder being vertical and means for introducing air and combustants so that they flow tangentially along said cylindrical wall surface so that during operation said wall acts as an ignition surface and directs and constrains combustants in a spiraling cyclonic flow path along substantially the full chamber height.

11. An incineration combustion chamber, as claimed in claim 10, wherein the cylindrical inner wall surface is substantially uninterrupted to promote the uninterrupted flow of slag to the bottom of the combustion chamber and to maintain the flow of combustants against the wall which serves as an ignition surface.

12. An incineration combustion chamber, as claimed in claim 11, comprising, in addition, a constriction on the upper portion of the cylindrical inner wall surface to turn and redirect heat back into the lower part of combustion chamber, to prolong the retention time, and to prevent the rapid exit of the burning materials.

13. An incineration combustion chamber, as claimed in claim 12, comprising in addition, means for introducing additional air so that it flows tangentially along said cylindrical wall surface to promote the cyclonic flow, to promote complete combustion, and to permit regulation of the combustion.

14. An incineration combustion chamber, as claimed in claim 13, where the air introduction means is above the combustant introduction means.

15. An incineration combustion chamber, as claimed in claim 14, wherein the combustant introduction means comprises an inlet directed at an angle having a horizontal component 45° to a tangent to the inner wall surface and having a downward component of 10° from horizontal and the air introduction means comprises an inlet directed at an angle having a horizontal component of 45° to a tangent to the inner wall surface and having a downward component of 10° from horizontal to promote a prolonged contact of the fuel with the ignition surface and allow more complete mixture of the air and fuel.

16. A multi-chambered burning enclosure, as claimed in claim 9, wherein the filter material comprises high alumina aggregate.

* * * * *